US010021961B2

(12) United States Patent
Tschol et al.

(10) Patent No.: US 10,021,961 B2
(45) **Date of Patent: *Jul. 17, 2018**

(54) HEAD FOR AN ORAL CARE IMPLEMENT

(71) Applicant: The Gillette Company, Boston, MA (US)

(72) Inventors: Armin Tschol, Frankfurt am Main (DE); Erwin Mark, Eschborn (DE); Tilmann Winkler, Kronberg/Taunus (DE); Franziska Schmid, Frankfurt am Main (DE)

(73) Assignee: The Procter & Gamble Company, Cincinnati, OH (US)

( * ) Notice: Subject to any disclaimer, the term of this patent is extended or adjusted under 35 U.S.C. 154(b) by 296 days.

This patent is subject to a terminal disclaimer.

(21) Appl. No.: 14/946,511

(22) Filed: Nov. 19, 2015

(65) Prior Publication Data

US 2016/0135578 A1 May 19, 2016

(30) Foreign Application Priority Data

Nov. 19, 2014 (EP) ..... 14193794

(51) Int. Cl.

| | |
|---|---|
| ***A46B 9/04*** | (2006.01) |
| ***A46B 9/02*** | (2006.01) |
| *A46B 15/00* | (2006.01) |

(52) U.S. Cl.

CPC ..... *A46B 9/04* (2013.01); *A46B 9/025* (2013.01); *A46B 9/026* (2013.01); *A46B 9/028* (2013.01);

(Continued)

(58) Field of Classification Search

CPC ..... A46B 9/04; A46B 9/025; A46B 9/026; A46B 9/028; Y10S 15/05

(Continued)

(56) References Cited

U.S. PATENT DOCUMENTS 5,305,489 A * 4/1994 Lage ..... A46B 5/02 15/143.1

5,392,483 A 2/1995 Unilever (Continued)

FOREIGN PATENT DOCUMENTS

AU 2003252861 A1 4/2005
CN 201894324 A1 7/2011

(Continued)

OTHER PUBLICATIONS

PCT/US2015/061509 International Search Report (dated Mar. 7, 2016).

(Continued)

*Primary Examiner* — Weilun Lo
(74) *Attorney, Agent, or Firm* — Parker D. McCrary; James E. Oehlenschlager

(57) ABSTRACT

A head for an oral care implement has at least a first row of tufts comprising a plurality of filaments having free ends and fixed ends being opposite the free ends and being fixed on a mounting surface of the head. The filaments of the at least first row of tufts extend from the mounting surface of the head in different length extensions thereby defining with the filaments' free ends an upper top cleaning surface in the form of a continuous wave-shape. The tufts of the at least first row are inclined with respect to the mounting surface.

12 Claims, 2 Drawing Sheets

(52) U.S. Cl.
CPC ... *A46B 15/0081* (2013.01); *A46B 2200/1066* (2013.01)

(58) Field of Classification Search
USPC ..... 15/167.1, 167.2; D4/104
See application file for complete search history.

(56) References Cited

U.S. PATENT DOCUMENTS

| | | | | |
|---|---|---|---|---|
| 6,308,367 | B1 * | 10/2001 | Beals | A46B 5/02 15/167.1 |
| 6,405,401 | B1 * | 6/2002 | Hellerud | A46B 9/045 15/167.1 |
| 7,854,036 | B2 | 12/2010 | GlaxoSmithKline | |
| 2002/0004964 | A1 | 1/2002 | Luchino et al. | |
| 2005/0039279 | A1 * | 2/2005 | Koeth | A46B 5/0025 15/167.1 |
| 2008/0066251 | A1 | 3/2008 | Chenvainu et al. | |
| 2010/0115724 | A1 * | 5/2010 | Huang | A46B 9/025 15/167.1 |
| 2010/0223745 | A1 * | 9/2010 | Kraemer | A46B 9/02 15/167.1 |
| 2010/0263149 | A1 * | 10/2010 | Ballmaier | A46B 5/02 15/167.1 |
| 2010/0325827 | A1 * | 12/2010 | Huang | A46B 9/026 15/167.1 |
| 2012/0291212 | A1 * | 11/2012 | Montagnino | A46B 5/0066 15/167.1 |
| 2013/0007969 | A1 | 1/2013 | Dreisen et al. | |
| 2014/0082871 | A1 | 3/2014 | Su et al. | |
| 2014/0359956 | A1 * | 12/2014 | Jungnickel | A46B 9/025 15/167.1 |
| 2015/0289638 | A1 | 10/2015 | Jungnickel et al. | |

FOREIGN PATENT DOCUMENTS

| | | | |
|---|---|---|---|
| JP | 2006130012 | A1 | 5/2006 |
| WO | WO 9725898 | A1 | 7/1997 |

OTHER PUBLICATIONS

PCT/US2015/061510 International Search Report (dated Feb. 4, 2016).
PCT/US2015/061512 International Search Report (dated Feb. 4, 2016).
All Office Actions, U.S. Appl. No. 14/946,547.
All Office Actions, U.S. Appl. No. 14/946,566.

* cited by examiner

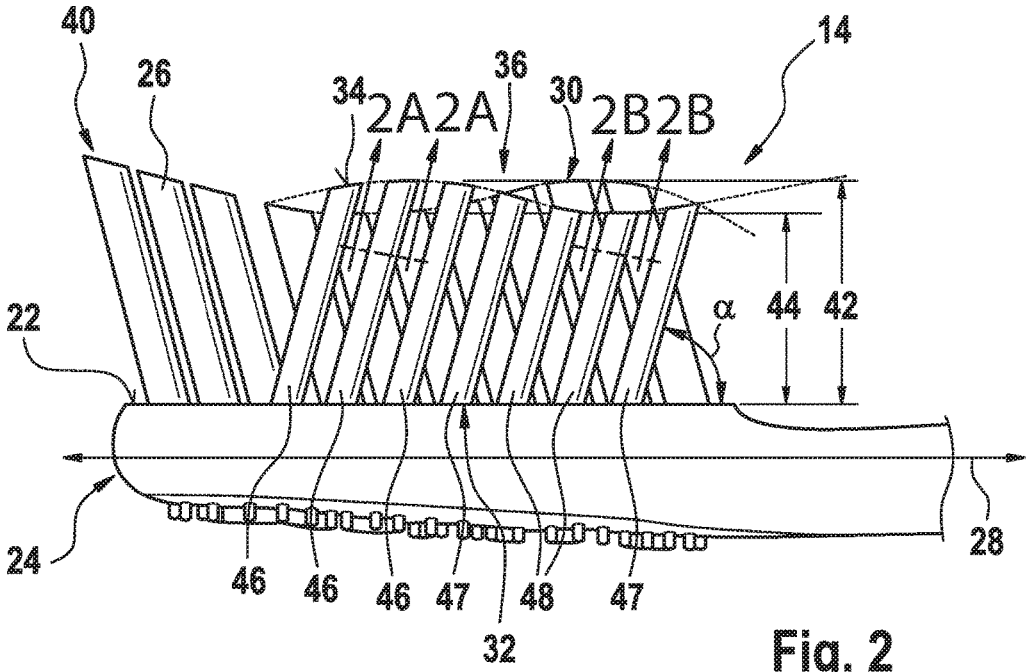
Fig. 2
Fig. 2A
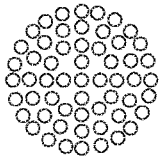
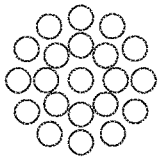
Fig. 2B
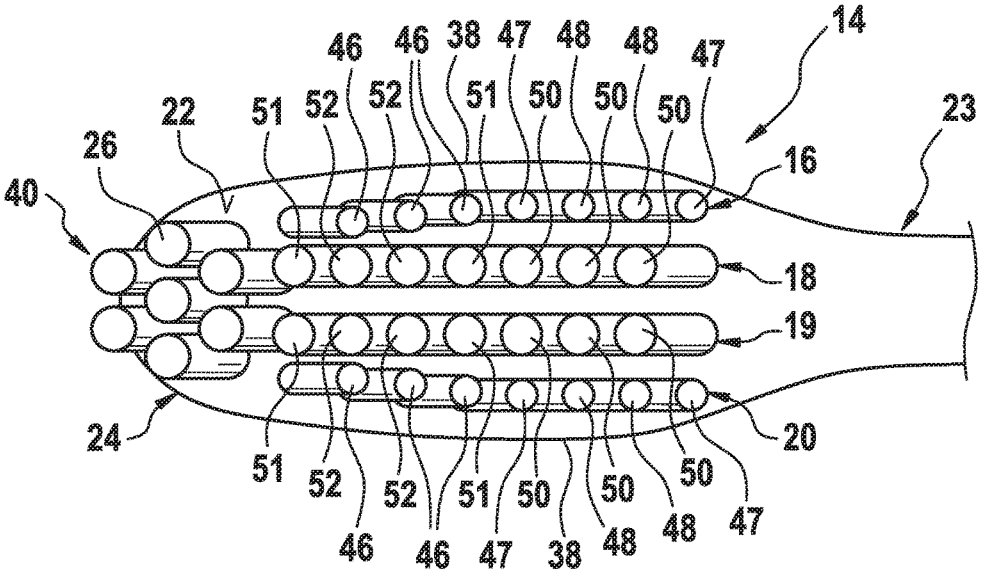
Fig. 3

HEAD FOR AN ORAL CARE IMPLEMENT

FIELD OF THE INVENTION

The present disclosure is concerned with a head for an oral care implement and in particular with such a head comprising at least one row of tufts having an upper top cleaning surface in the form of a continuous wave-shape.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

Toothbrushes comprising a plurality of filaments extending in different length extensions with respect to the mounting surface from which they extend are also known in the art. For example, a toothbrush is known having a bristle support head with a plurality of bristles densely implanted thereon. A brushing surface is formed by the ends of the bristles which brushing surface is wave-shaped to increase the contact area between the teeth and the brushing surface of the filaments to remove contaminants from interdental spaces more effectively.

While toothbrushes comprising this type of filament assemblies may clean the outer buccal face of teeth adequately, they are not as well suited to provide adequate removal of plaque and debris from the gingival margin, interproximal areas, lingual surfaces and other hard to reach areas of the mouth in a sensitive and gentle manner.

It is an object of the present disclosure to provide a head for an oral care implement which provides improved cleaning properties, in particular with respect to interproximal and gingival marginal regions of the teeth. It is also an object of the present disclosure to provide an oral care implement comprising such head.

SUMMARY OF THE INVENTION

In accordance with one aspect, a head for an oral care implement is provided that comprises:

- at least a first row of tufts comprising a plurality of filaments having free ends and fixed ends being opposite the free ends and being fixed on a mounting surface of the head,
- the filaments of the at least first row of tufts extending from the mounting surface of the head in different length extensions thereby defining with the filaments' free ends an upper top cleaning surface in the form of a continuous wave-shape, wherein the tufts of the at least first row are inclined with respect to the mounting surface.

In accordance with one aspect, an oral care implement is provided that comprises such head.

BRIEF DESCRIPTION OF THE DRAWINGS

The invention is described in more detail below with reference to various embodiments and figures, wherein:

FIG. 2 shows a schematic side view of the head of FIG. 1;

FIG. 2A shows a cross-sectional view a tuft of the longest length extension;

FIG. 2B shows a cross-sectional view a tuft of the shortest length extension; and FIG. 3 shows a schematic top-down view of the head of FIG. 1.

DETAILED DESCRIPTION OF THE INVENTION

Figure 1:
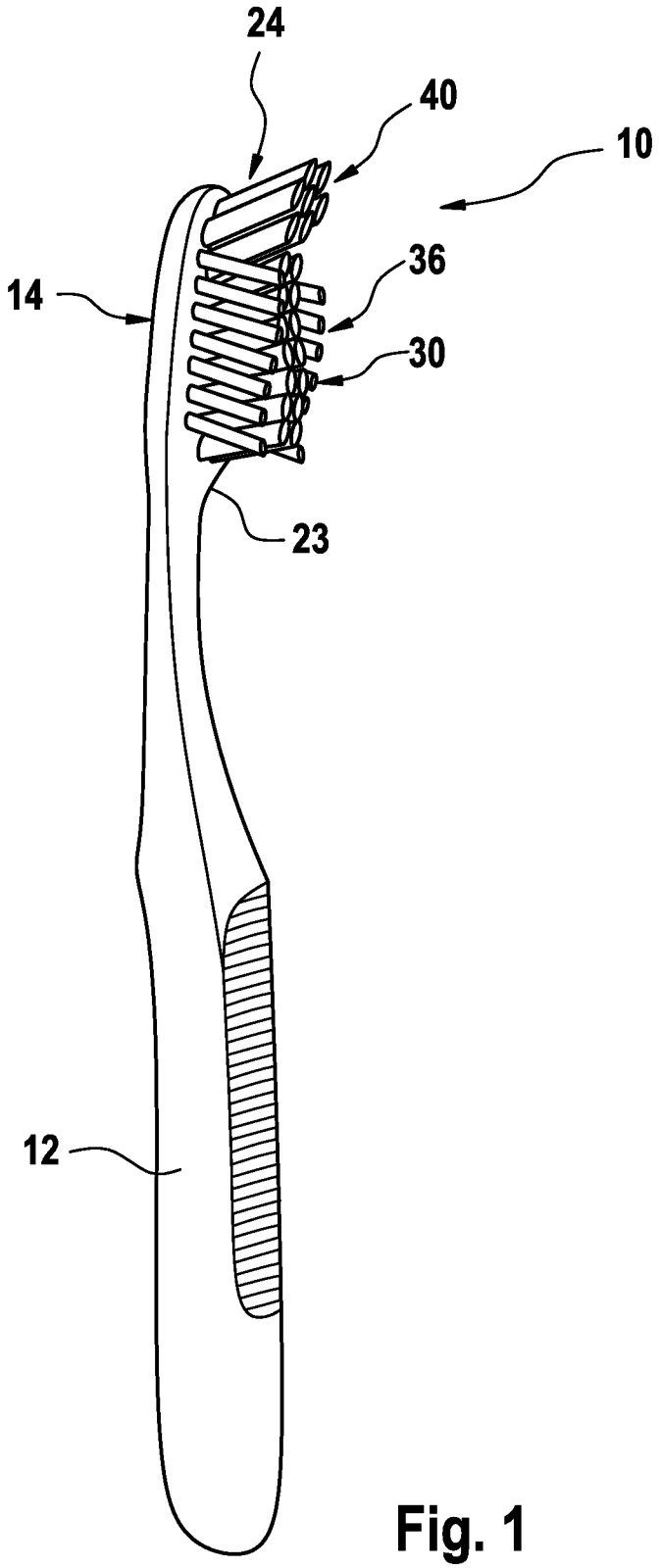
FIG. 1 shows a schematic perspective view of an embodiment of an oral care implement comprising an example embodiment of a head.

A head for an oral care implement in accordance with the present disclosure comprises at least a first row of tufts, each tuft comprising a plurality of filaments. Each filament has a fixed end and a free end which is opposite the fixed end. The fixed ends of the filaments are fixed/secured on a mounting surface of the head and extend therefrom in a filaments' length extension. The free ends of the filaments of the tufts of said at least first row define an upper top cleaning surface which may come into contact with tooth surfaces during a brushing/cleaning action. The filaments extend from the mounting surface in different length extensions so that the upper top cleaning surface has the form of a continuous wave-shape.

In the context of this disclosure, the "length extension" or "length" of a filament may be defined by the distance measured from the mounting surface of the head and the filament's free/upper/loose end which may come into contact with tooth surfaces during a brushing/cleaning action.

In the context of the present disclosure the term "wave-shape" may be defined by any shape or configuration of the upper top cleaning surface having the form of a wave along the length extension of the row of tufts when the row of tufts is seen in a side view. In other words, the upper top cleaning surface of the row of tufts may have the form of a longitudinal wave.

In the context of the present disclosure the term "continuous wave-shape" means that the wave-shaped configuration of the upper top cleaning surface is formed substantially homogeneously, i.e. substantially without any steps, interruptions or platforms. In other words, the filaments extend from the mounting surface in a manner, that the transition between one filaments' length extension to the next longer or shorter filaments' length extension is smooth and does not show any significant steps. For example, the wave may have a substantially sine-wave shaped configuration. In other words, the shortest filaments of the row of tufts form a "wave trough" and the longest filaments form a "wave crest" wherein the transition between the wave trough and the wave crest is continuous. A difference in height/length of two adjacent/neighboring tufts may be about 0.1 mm to about 0.5 mm. In addition or alternatively, a difference in height/length of two adjacent/neighboring filaments may be about 0.1 mm to about 0.5 mm.

The wave-shaped formation of the upper top cleaning surface may increase the contact area between the filaments' free ends and the teeth, and may facilitate adaption of the tufts to the teeth contour to clean the teeth more effectively.

The tufts of the at least first row are inclined with respect to the mounting surface of the head, thereby defining an inclination angle $\alpha$ between the respective tuft and the mounting surface. In other words, the tufts may be angled relative to an imaginary line which is tangent to or co-planar with the mounting surface of the head through which the tuft is secured to the head. Such specific arrangement of tufts may improve cleaning properties of the head for an oral care implement, in particular with respect to interdental areas, as the inclination of the tufts may facilitate that the filaments may slide into small gaps between the teeth to clean the interdental areas/gaps. The inclined alignment of the tufts may force at least the longer filaments to perform a poke, pivot and slide movement into and in the interproximal areas. Once the filaments enter the interdental gaps, the filaments may straighten up, elongate and, thus, may reach deeply into said gaps. The inclined arrangement of the filaments may assure access to narrow spaces and the filaments may be able to penetrate deeply into the gaps between teeth and may remove plaque and other residues more effectively.

The continuous wave-shaped upper top cleaning surface of the at least first row of inclined tufts may not only provide improved adaption of the tufts to the teeth contour to increase the contact area, but may also assure that at least the greater/longer filaments may easily slide into small gaps between the teeth to clean the interdental areas/gaps, while the shorter filaments may clean the occlusal, buccal and lingual surfaces of the teeth. The filaments of greater/longer length may assure access to narrow spaces and may be able to penetrate deeply into the gaps between teeth and remove plaque and other residues more effectively.

The tufts of the at least first row may be inclined with respect to the mounting surface in a direction being substantially parallel to the longitudinal extension of the head. The longitudinal extension of the head may be defined by an extension between a proximal end of the head which is attached or attachable to a handle, and a distal end being opposite the proximal end. Such specific arrangement of tufts may improve cleaning properties of the head, as the inclination of the tufts may facilitate that the filaments may slide into small gaps between the teeth to clean the interdental areas/gaps more effectively when the head is moved in a forth and back movement along a row of teeth.

The tufts may be inclined with respect to the mounting surface by an inclination angle $\alpha$ from about 65° to about 80°, optionally from about 70° to about 80°, further optionally from about 74° to about 78°, even further optionally about 74° or about 75°. Experiments revealed that filaments having an inclination angle $\alpha$ from about 65° to about 80°, optionally from about 70° to about 80° are more likely to penetrate into interdental gaps. Filaments having an inclination angle $\alpha$ of more than about 80° showed low likelihood of interdental penetration as these filaments bend away from the direction of travel or skip over the teeth. Further, surprisingly, it was found, that filaments having an inclination angle $\alpha$ from about 74° to about 78°, optionally from about 74° to about 75°, further optionally about 74° or about 75° may further improve cleaning performance of the head for an oral care implement. Experiments revealed that such filaments are even more likely to penetrate into interdental gaps.

A difference in length between the longest length extension and the shortest length extension of the filaments may be from about 1.5 mm to about 2.0 mm, optionally about 1.7 mm Such difference in length may allow good penetration of the longer filaments into interdental spaces whereas the shorter filaments may clean the buccal, lingual, and occlusal tooth surfaces effectively. Surprisingly, it was found out, that a length difference of about 1.5 mm to about 1.7 mm provides both, improved interdental cleaning properties by means of the longer filaments and good cleaning performance on the buccal, lingual and occlusal surfaces of the teeth by means of the shorter filaments.

Each filament has a longitudinal axis extending along the filaments' length extension, and a cross-sectional area extending in a plane that is substantially perpendicular to the longitudinal axis. The cross-sectional area of the filaments having the longest length extension may be smaller in size, as in FIG. 2A, compared to the cross-sectional area of the filaments having the shortest length extension, as in FIG. 2B. In other words, due to the smaller cross-sectional area, the filaments of the longer length may have a lower bending stiffness compared to filaments of the same length and a larger cross-sectional area. Thus, the longer filaments may provide relatively soft and gentle brushing properties.

Since the longer filaments forming the "wave crest" may have a smaller cross-sectional area compared to the shorter filaments forming the "wave trough", the longer filaments may show higher flexibility, i.e. lower bending stiffness, compared to the shorter filaments. The decrease in bending stiffness may result in a smoother/gentler and, thus, improved cleaning sensation during a brushing action. The relatively long and thin filaments may provide a gentle cleaning action; a stinging sensation/unpleasant feeling on the gums during brushing may be substantially avoided. Further, the increase in flexibility and the thin dimension may further facilitate the longer filaments to penetrate into interdental spaces, gingival marginal regions/pockets and other hard to reach areas more easily. In other words, the filaments of longer length may further assure access to narrow spaces and may be able to penetrate into the gaps between teeth even more easily, while the shorter filaments having higher bending stiffness may clean the buccal, lingual, and occlusal tooth surfaces effectively. Further, the shorter filaments having the higher bending stiffness may provide a counterforce to the longer and softer filaments. The counterforce may allow the longer filaments to transmit sufficient contact pressure to clean the teeth effectively and to force the filaments to penetrate into interproximal areas. Thus, relatively thin filaments can be used in the row of tufts in order to access and clean narrow interdental spaces with sufficient contact pressure during a brushing process.

Further, the smooth and continuous transition from the longer filaments with lower bending stiffness to the shorter filaments with higher bending stiffness may also provide a smooth transition from interdental filament penetration to a more scrubbing effect on the substantially flat tooth surfaces when the head, for example, is moved along the longitudinal extension of the row of tufts. In other words, a head for an oral care implement is provided which provides both, interdental cleaning properties and effective cleaning on the substantially flat tooth surfaces, while the transition from one cleaning property to the other is relatively smooth which may result in an improved brushing sensation. The longer and shorter filaments within one row of tufts may work synergistically together. The head may provide gentle and effective brushing performance and may remove plaque and other residues more effectively both, on substantially flat surfaces as well as in interdental spaces.

The filaments may have a circular or non-circular cross-sectional area. For example, the cross-sectional area can be ellipsoid, squared, rectangular, triangular, cross-shaped, or it can be a prolate ellipsoid with flattened long sides, even though other shapes may be considered as well.

For example, the cross-sectional area of the longest filaments may be substantially circular with a diameter of about 0.15 mm to about 0.18 mm, optionally about 0.152 mm (6 mil) or about 0.178 mm (7 mil). In addition or alternatively, the cross-sectional area of the shortest filaments may be substantially circular with a diameter of about 0.20 mm to about 0.23 mm, optionally about 0.203 mm (8 mil) or about 0.229 mm (9 mil).

The filaments may be made of nylon with or without an abrasive such as kaolin clay, polybutylene terephtalate (PBT) with or without an abrasive such as kaolin clay and/or from nylon indicator material colored at the outer surface. The coloring on the nylon indicator material is slowly worn away as the filament is used over time to indicate the extent to which the filament is worn. The filaments may comprise one material or two different materials, for example the filaments may comprise an island-in-a-sea structure or a core-sheath structure.

At least some of the filaments, for example the filaments of the longer length may be tapered filaments having a pointed tip. Tapered filaments may achieve optimal penetration in areas between two teeth as well in gingival pockets during brushing and may provide improved cleaning properties. The pointed tip may be needle shaped, may comprise a split, a flagged or a feathered end. The tapering portion may be produced by a chemical and/or mechanical tapering process.

Further, the filaments may have a textured outer surface which may be crimped, notched, dimpled, flocked or may comprise a series of ribs, for example. Textured filaments tend to enhance cleaning effects on the teeth.

In addition or alternatively, the upper top cleaning surface of each tuft within said at least first row may have a specific topography/geometry, which may be shaped to optimally adapt to the continuous wave-shaped formation of the row of tufts. For example, the upper top cleaning surface of one tuft within the row may have a topography which is chamfered, concave or convex to contribute to the overall continuous wave-shape configuration of the row of tufts. This may provide an even smoother transition from the longer filaments with lower bending stiffness to the shorter filaments with higher bending stiffness resulting in an even more improved brushing sensation.

Each tuft of the at least first row may have a longitudinal axis and a cross-sectional area extending in a plane that is perpendicular to the longitudinal axis. The cross-sectional area of each tuft within the at least first row may have substantially the same size, and the tuft comprising the filaments of the longest length extension may comprise a higher amount of filaments than the tuft comprising the filaments of the shortest length extension. In other words, the tufts arranged within one row may have substantially the same diameter resulting in a homogeneous/uniform appearance. Further, since the tuft of longer filaments comprises a higher amount of filaments, theses relatively soft filaments may provide a counterforce toward each other during a brushing action. The counterforce may allow the longer and softer filaments to transmit sufficient contact pressure to clean the teeth effectively and to force the filaments to penetrate into interproximal areas. The tufts may have a circular or non-circular cross-sectional area. For example, the cross-sectional area can be ellipsoid, squared, rectangular, triangular, cross-shaped, or it can be a prolate ellipsoid with flattened long sides, even though other shapes may be considered as well. In case the cross-sectional area is circular, the diameter of the tufts may be about 1.5 mm to about 2 mm.

The head may comprise at least a second row of tufts comprising a plurality of filaments. The second row may be substantially parallel to the first row, and the filaments of the tufts of the second row may extend from the mounting surface in different length extensions, thereby defining with the filaments' free ends an upper top cleaning surface in the form of a continuous wave-shape as discussed above with respect to the first row of tufts. The tufts of the first row may be inclined with respect to the mounting surface in one direction, and the tufts of the second row may be inclined with respect to the mounting surface in the opposite direction. The at least two rows of tufts may be oriented in different directions, thereby describing a so-called criss-cross pattern when the head is seen from a side view. The at least two rows of tufts may be oriented substantially parallel to the longitudinal extension, i.e. along the length of the head and/or orthogonal thereto, i.e. across the width of the head and/or part way between the length and the width of the head. Further, the tufts of the at least two rows can also be oriented at different angles $\alpha$. As the at least two rows of tufts are inclined in opposite directions, penetration of at least the longer filaments into interdental areas may be provided each time when the head is moved into said respective opposite directions. Thus, interdental cleaning is provided more frequently during a brushing process compared to an oral care implement having tufts being inclined in only one specific direction.

The tufts of the second row may be arranged in a manner that the wave-shape form is contra-cyclical with respect to the wave-shape form of the first row to further improve brushing performance of the head for an oral care implement. For example, the form of the wave-shape configuration of both rows may be substantially sinusoidal and a phase shift/difference between the first row and the second row may be from about 90° to about 180°. A phase shift of about 180° may provide effective cleaning performance when the brush is moved in opposite directions with respect to the length extension of the rows of tufts, thereby improving the brushing sensation. When the head is seen in a side view, a "wave crest" may alternate with a "wave trough". In case the head is moved along a row of teeth, different cleaning actions may be performed simultaneously. The longer filaments may provide interdental cleaning properties, while the shorter filaments may clean the substantially flat tooth surfaces. Further, the overall appearance of the tuft pattern of the head may be improved.

Each filament of the tufts of the second row may have a longitudinal axis and a cross-sectional area extending in a plane that is perpendicular to the longitudinal axis. The filaments of the longest length extension may have a cross-sectional area being smaller than the cross-sectional area of the filaments of the shortest length extension. The second row of tufts may further improve cleaning properties of the head since even more tufts are provided to clean substantially flat teeth surfaces and interproximal areas in a pleasant manner.

The head may further comprise a third row of tufts comprising a plurality of filaments and a fourth row of tufts comprising a plurality of filaments. The third and the fourth rows of tufts may be substantially parallel to the first and the second rows of tufts. The third and the fourth row may each have an upper top cleaning surface which is wave-shaped as discussed above with respect to the first row of tufts.

The tufts of the first row and the tufts of the fourth row may be inclined in a direction toward the proximal end of the head, while the tufts of the second row and the tufts of the third row may by inclined in a direction toward the distal end of the head. For example, both outer rows arranged along the outer edge of the mounting surface may be inclined in the direction toward the proximal end of the head, and both inner rows may be inclined in the direction toward the distal end of the head, thereby describing a so-called criss-cross tuft pattern in a side perspective view of the head. Such tuft arrangement may even further improve the cleaning efficiency of the head. When the head of an oral care implement is moved in a forward motion along its longitudinal extension, at least the longer filaments being inclined in the direction toward the distal end of the head may perform a poke, pivot and slide motion thereby penetrating into interproximal areas from a forward direction. When the head is moved in a backward motion, i.e. in the opposite direction of the forward motion, at least the longer filaments being inclined in the direction toward the proximal end of the head may perform the poke, pivot and slide motion thereby penetrating into interproximal areas from the backward direction. Thus, a criss-cross tuft pattern may allow at least the longer filaments to penetrate into interproximal areas with every single forward and backward brushing stroke along the occlusal, buccal and lingual surfaces of the teeth.

The continuous wave-shaped upper top cleaning surface of the third row of tufts may have the same configuration as the upper top cleaning surface of the second row of tufts, whereas the continuous wave-shaped upper top cleaning surface of fourth row of tufts may have the same configuration as the upper top cleaning surface of the first row of tufts. The first and the fourth rows may be arranged at the outer edges of the mounting surface of the head, respectively, while the second and the third rows may be arranged between the first and the fourth rows, i.e. along the longitudinal extension of the head in the central part of the mounting surface. In other words, each row of tufts may be arranged substantially parallel with respect to the longitudinal extension of the head. A phase shift/difference between the first row and the second row may be about 180°, and a phase shift/difference between the fourth row and the third row may be about 180°, as well. The inner two rows, i.e. the second and the third rows may clean substantially flat teeth surfaces by means of shorter filaments, while the first and the fourth rows may clean interdental spaces by means of the longer filaments simultaneously, and vice versa. Further, the overall appearance of the tuft pattern of the head may be improved.

The tufts of the at least first row may be attached to the head by means of a hot tufting process. One method of manufacturing the oral care implement may comprise the following steps: In a first step, tufts are formed by providing a desired amount of filaments. In a second step, the tufts are placed into a mold cavity so that ends of the filaments which are supposed to be attached to the head extend into said cavity. The opposite ends of the filaments not extending into said cavity may be either end-rounded or non-end-rounded. For example, the filaments may be non-end-rounded in case the filaments are tapered filaments having a pointed tip. In a third step the head or an oral care implement body comprising the head and the handle may be formed around the ends of the filament extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral care implement. In other words, the tufts attached to the head by means of a hot tufting process are not doubled over a middle portion along their length and are not mounted in the head by using an anchor/staple. The tufts are mounted on the head by means of an anchor-free tufting process.

Alternatively, the tufts of the at least first row may be attached to the head by means of a conventional stapling process utilizing anchor wires that may be pushed into respective tuft holes provided in the mounting surface of the head.

Optionally, the head for the oral care implement may further comprise at least one thermoplastic elastomer element for cleaning and/or massaging the teeth and/or soft tissues of the oral cavity. The thermoplastic elastomer element may be made up of a unitary structure or of a number of substructures. For example, the thermoplastic elastomer element may comprise a large unitary bristle, i.e. a nub, or a number of smaller bristles. The thermoplastic elastomer element may also comprise a fin, cup, like a prophy cup, or a curved or straight wall.

The oral care implement may be a toothbrush comprising a handle and a head according to any of the embodiments described above. The head extends from the handle and may be either repeatedly attachable to and detachable from the handle, or the head may be non-detachably connected to the handle. The toothbrush may be an electrical or a manual toothbrush.

The following is a non-limiting discussion of an example embodiment of an oral care implement in accordance with the present disclosure, where reference to the Figures is made.

FIGS. 1 to 3 show an embodiment of an oral care implement 10, which could be a manual or an electrical toothbrush 10 comprising a handle 12 and a head 14 extending from the handle 12 in a longitudinal direction. A plurality of tufts 46, 47, 48, 50, 51, 52, 26 is secured to the head 14 by means of a hot tufting or conventional stapling process. Each tuft 46, 47, 48, 50, 51, 52, 26 comprises a plurality of filaments having free ends 30 and fixed ends 32 being opposite the free ends 30 and being fixed on a mounting surface 22 of the head 14.

Four rows 16, 18, 19, 20 of tufts 46, 47, 48, 50, 51 are arranged substantially parallel to the longitudinal extension 28 of the head 14. The longitudinal extension 28 of the head 14 extends between a proximal end 23 of the head 14 which is attached or attachable to the handle 12 and a distal end 24 being opposite the proximal end 23. A first row 16 of tufts 46, 47, 48 and a fourth row 20 of tufts 46, 47, 48 (in the following also referred to as "outer rows" 16, 20) are arranged along the outer edge 38 of the mounting surface 22, while a second row 18 of tufts 50, 51, 52 and a third row 19 of tufts 50, 51, 52 (in the following also referred to as "inner rows" 18, 19) are arranged in the central part of the mounting surface 22, i.e. between the first row 16 and the fourth row 20.

The filaments of each row 16, 18, 19, 20 extend from the mounting surface 22 of the head 14 in different length extensions so that the filaments' free ends 30 of each row 16, 18, 19, 20 define an upper top cleaning surface 34 in the form of a continuous wave-shape 36. A difference in length between the longest length extension 42 and the shortest length extension 44 may be from 1.5 mm to about 2.0 mm, optionally about 1.7 mm.

Each row 16, 18, 19, 20 comprises seven tufts 46, 47, 48, 50, 51, 52, each tuft 46, 47, 48, 50, 51, 52 being composed of filaments having a longitudinal axis and a cross-sectional area extending in a plane which is perpendicular to the longitudinal axis. The filaments of the longest length extension 42 have a cross-sectional area which is smaller than the cross-sectional area of the filaments of the shortest length extension 44.

With respect to the outer rows 16, 20, the first tuft 47 being arranged closest to the proximal end 23, i.e. closest to the handle 12, may be composed of filaments having a substantially circular cross-sectional area with a diameter of about 0.178 mm (7 mil). The next two tufts 48 following the first tuft 47 may be composed of filaments having a substantially cross-sectional area with a diameter of about 0.203 mm (8 mil), the next following tuft 47 may be composed of filaments having a substantially cross-sectional area with a diameter of about 0.178 mm (7 mil), and the next following three tufts 46 which are most remote from the handle 12 may be composed of filaments having a substantially cross-sectional area with a diameter of about 0.152 mm (6 mil).

The two tufts 48 following the first tuft 47 being arranged closest to the proximal end 23 of the head 14 comprise the filaments with the shortest length extension 44, whereas the three tufts 46 being most remote from the handle 12 comprise the filaments with the longest length extension 42. The distance 42 between the free ends 30 of the longest filaments and the mounting surface 22 may be about 11.2 mm, whereas the distance 44 between the free ends 30 of the shortest filaments and the mounting surface 22 may be about 9.5 mm.

With respect to the inner rows 18, 19, the first tuft 51 being arranged closest to the distal end 24, i.e. furthest away from the handle 12, may be composed of filaments having a substantially circular cross-sectional area with a diameter of about 0.178 mm (7 mil). The next two tufts 52 following the first tuft 51 may be composed of filaments having a substantially cross-sectional area with a diameter of about 0.203 mm (8 mil), the next following tuft 51 may be composed of filaments having a substantially cross-sectional area with a diameter of about 0.178 mm (7 mil), and the next following three tufts 50 which are closest to the handle 12 may be composed of filaments having a substantially cross-sectional area with a diameter of about 0.152 mm (6 mil).

The two tufts 52 following the first tuft 51 being arranged closest to the distal end 24 of the head 14 comprise the filaments with the shortest length extension 44, whereas the three tufts 50 being closest to the handle 12 comprise the filaments with the longest length extension 42. The distance 42 between the free ends 30 of the longest filaments and the mounting surface 22 may be about 11.2 mm, whereas the distance 44 between the free ends 30 of the shortest filaments and the mounting surface 22 may be about 9.5 mm.

In other words, the tufts 50, 51, 52 of the inner rows 18, 19 are arranged in a manner that the continuous wave-shaped form is contra-cyclical with respect to the continuous wave-shaped form of the outer rows 16, 20.

The tufts 46, 47, 48 of the outer rows 16, 20 may have a substantially circular cross-sectional area with a diameter of about 1.5 mm and the tufts 50, 51, 52 of the inner rows 18, 19 may have a substantially circular cross-sectional area with a diameter of about 2 mm. Since the diameters of the tufts 46, 47, 48 of the outer rows 16, 20 and of the tufts 50, 51, 52 of the inner rows 18, 19, respectively, have substantially the same dimensions, the tufts 46, 50 comprising filaments with the smaller cross-sectional area comprise a higher number of filaments compared to the tufts 47, 48, 51, 52 having filaments with a larger cross-sectional area.

All tufts 46, 47, 48 of the outer rows 16, 20 are inclined toward the proximal end 23 of the head 14, i.e. toward the handle 12 relative to an imaginary line which is tangent to or co-planar with the mounting surface 22 of the head 14. The Tufts 50, 51, 52 of the inner rows 18, 19 are inclined in the opposite direction, i.e. toward the distal end 24 of the head 14. In other words, the rows 16, 18, 19, 20 of tufts 46, 47, 48, 50, 51, 52 define a criss-cross pattern when the head is seen in a side view to improve cleaning properties when the toothbrush 10 is moved in the respective opposite directions.

The tufts 46, 47, 48, 50, 51, 52 of the rows 16, 18, 19, 20 may be inclined with respect to the mounting surface 22 by an inclination angle $\alpha$ from about 65° to about 80°, optionally from about 70° to about 80°, further optionally from about 74° to about 78°, even further optionally about 74° or about 75° to provide improved cleaning properties of the toothbrush 10.

In the toe region at the distal end 24 of the head 14, i.e. furthest away from the handle 12, a crescent-shaped cluster 40 of tufts 26 is attached to the head 14. Each tuft 26 may have a substantially circular cross-sectional area with a diameter of about 2 mm and may be composed of filaments with a substantially circular cross-sectional area having a diameter of about 0.203 mm (8 mil). Each tuft 26 of the crescent-shaped cluster 40 may be angled by about 80° or less to an imaginary line which is tangent to or co-planar with the mounting surface 22 of the head 14 through which the tuft 26 is secured to the head 14. The tufts 26 of the crescent-shaped cluster 40 are tilted/angled away from the handle 12 and extend past the distal end 24 of the head 14 of the toothbrush 10 and, thus, may clean molars (e.g. wisdom teeth and second molars) in the back of the oral cavity in a more sufficient manner.

In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A toothbrush head (14) for an oral care implement (10) comprising:

at least a first row (16) of tufts (46, 47, 48) comprising a plurality of filaments having free ends (30) and fixed ends (32) being opposite the free ends (30) and being fixed on a mounting surface (22) of the head (14), and the filaments of the at least first row (16) of tufts (46, 47, 48) extending from the mounting surface (22) of the head (14) in different length extensions (42, 44) thereby defining with the filaments' free ends (30) an upper top cleaning surface (34) in the form of a continuous wave-shape (36) comprising at least one wave crest and at least one wave trough located between a first tuft and a last tuft of the at least first row (16) of tufts, and the tufts (46, 47, 48) of the at least first row (16) are inclined with respect to the mounting surface (22), at least a second row (18) of tufts (50, 51, 52) comprising a plurality of filaments, the second row (18) being substantially parallel to the first row (16), and the filaments of the second row (18) extend from the mounting surface (22) in different length extensions (42, 44) thereby defining with the filaments' free ends (30) an upper top cleaning surface (34) in the form of a continuous wave-shape (36) comprising at least one wave crest and at least one wave trough located between a first tuft and a last tuft of the at least second row (18) of tufts (50, 51, 52), and the tufts (50, 51, 52) of the second row (18) are inclined with respect to the mounting surface (22)

wherein the tufts (50, 51, 52) of the second row (18) are arranged in a manner that the wave-shape form is contra-cyclical with respect to the wave-shape form of the first row (16), wherein the contra-cyclical wave-shape form is a phase shift between the first row (16) and the second row (18) from about 120 to about 180 degrees.

2. The toothbrush head (14) according to claim 1, wherein the tufts (46, 47, 48) of the at least first row (16) are inclined with respect to the mounting surface (22) in a direction substantially parallel to a longitudinal extension (28) of the head (14), the longitudinal extension (28) of the head (14) extending between a proximal end (23) of the head (14) which is attached or attachable to a handle (12) and a distal end (24) being opposite the proximal end (23).

3. The toothbrush head (14) according claim 1, wherein the tufts (46, 47, 48) of the at least first row (16) are inclined with respect to the mounting surface (22) by an inclination angle ($\alpha$) from about 65° to about 80.

4. The toothbrush head (14) according to claim 1, wherein a difference in length between the longest length extension (42) and the shortest length extension (44) is from about 1.5 mm to about 2.0 mm.

5. The toothbrush head (14) according claim 1, wherein each filament of the at least first row (16) has a longitudinal axis and a cross-sectional area extending in a plane that is perpendicular to the longitudinal axis, and the filaments of the longest length extension (42) have a cross-sectional area being smaller than the cross-sectional area of the filaments of the shortest length extension (44).

6. The toothbrush head (14) according to claim 1, wherein the longest filaments have a substantially circular cross-sectional area with a diameter of about 0.15 mm to about 0.18 mm.

7. The toothbrush head (14) according to claim 1, wherein the shortest filaments have a substantially circular cross-sectional area with a diameter of about 0.20 mm to about 0.23 mm.

8. The toothbrush head (14) according to claim 1, wherein the tufts (50, 51, 52) of the second row (18) are inclined in the opposite direction with respect to the inclination direction of the first row (16).

9. The toothbrush head (14) according to claim 1, wherein each filament of the second row (18) has a longitudinal axis and a cross-sectional area extending in a plane that is perpendicular to the longitudinal axis, and the filaments of the longest length extension (42) have a cross-sectional area being smaller than the cross-sectional area of the filaments of the shortest length extension (44).

10. The toothbrush head (14) according to claim 1, wherein the head (14) comprises a third row (19) of tufts (50, 51, 52) comprising a plurality of filaments and a fourth row (20) of tufts (46, 47, 48) comprising a plurality of filaments, the third row (19) and the fourth row (20) being substantially parallel to the first row (16) and the second row (18), and the tufts (46, 47, 48) of the first row (16) and the tufts (46, 47, 48) of the fourth row (20) are inclined in a direction toward the proximal end (23) of the head (14), and the tufts (50, 51, 52) of the second row (18) and the tufts (50, 51, 52) of the third row (19) are inclined in a direction toward the distal end (24) of the head (14).

11. The toothbrush head (14) according to claim 10, wherein the third row (19) has a continuous wave-shaped upper top cleaning surface (34) of the same configuration as the upper top cleaning surface (34) of the second row (18), and the fourth row (20) has a continuous wave-shaped upper top cleaning surface (34) of the same configuration as the upper top cleaning surface (34) of the first row (16), and the first row (16) and the fourth row (20) are arranged at the respective outer edges (38) of the mounting surface (22) of the head (14), and the second row (18) and the third row (19) are arranged between the first row (16) and the fourth row (20).

12. An oral care implement (10) comprising a toothbrush head (14) according to claim 1.

* * * * *